US005866286A

United States Patent [19]

Christy et al.

[11] Patent Number: 5,866,286

[45] Date of Patent: Feb. 2, 1999

[54] COLOR SELECTION BY MIXING PRIMARY TONERS

[75] Inventors: Orrin D. Christy, North Tonawanda; John E. Pickett, East Amberst; Mark A. Matheis, North Tonawanda; Leo Swanson, Niagara Falls, all of N.Y.

[73] Assignee: Moore Business Forms, Inc., Grand Island, N.Y.

[21] Appl. No.: 47,188

[22] Filed: Apr. 16, 1993

[51] Int. Cl.[6] ..... G03G 13/01

[52] U.S. Cl. ..... 430/45; 430/120

[58] Field of Search ..... 430/45, 120

[56] References Cited

U.S. PATENT DOCUMENTS

| | | | |
|---|---|---|---|
| 4,443,527 | 4/1984 | Heikens et al. | 430/39 |
| 4,777,106 | 10/1988 | Fotland et al. | 430/120 |
| 4,937,167 | 6/1990 | Moffat et al. | 430/137 |
| 5,017,450 | 5/1991 | Iwanari et al. | 430/106 |
| 5,102,763 | 4/1992 | Winnik et al. | 430/110 |
| 5,116,711 | 5/1992 | Kobayashi et al. | 430/106 |
| 5,120,632 | 6/1992 | Bertrand et al. | 430/109 |

FOREIGN PATENT DOCUMENTS

| | | | |
|---|---|---|---|
| 2059036 | 7/1992 | Canada | G03G 15/08 |
| 0 494 545 A2 | 7/1992 | European Pat. Off. | G03G 15/08 |

OTHER PUBLICATIONS

Patent Abstracts of Japan, vol. 10, No. 374 (P–527) (2431), 12 Dec. 1986 & JP–A–61 167 960 (29 Jul. 1986).

Xerox Disclosure Journal, vol. 3, No. 5, Sep./Oct. 1978, p. 291, Arthur Walsh, "Extending Developer Material Life."

Patent Abstracts of Japan, vol. 9, No. 177 (P–375) (1900), 23 Jul. 1985 & JP–A–60 051 848 (23 Mar. 1985).

Xerox Disclosure Journal, vol. 12, No. 2, Mar./Apr. 1987, p. 119, John Knapp, "Development Unit for Improved Color Developer Mixing."

*Primary Examiner*—Mark Chapman

*Attorney, Agent, or Firm*—Nixon & Vanderhye, P.C.

[57] ABSTRACT

A specified and designated, non-primary color print (imaging) is applied to a substrate (paper) by mixing at least first and second differently colored toner particles having substantially uniform physical characteristics, and introducing them in desired proportions into a fluidized bed. The toner powders are uniformly mixed together in the fluidized bed (as by using rotors in addition to applying fluidizing air to the bed), and then a substantially uniform electrostatic charge (e.g. about +6.5–+8 kV D.C., which can be applied by blades on the rotor) is applied to the bed, and then the electrostatically charged mixture of toner particles is applied to the substrate, to image uniform non-primary color symbols on the substrate. The uniform physical characteristics of the powders are size (the vast majority of particles having a size between about 5 microns and about 25 microns), a resistivity of greater than $10^{12}$ ohm-cm, and a flowability between a predefined minimum and maximum. When utilizing the fluidized bed as according to the invention, slight changes in chemical composition of the toners may be easily accommodated without change in the resulting uniform imaging.

22 Claims, 2 Drawing Sheets

DIFFERENT COLOR TONERS
+600V
37
30
+1.5kV
38
20
31
36
21
24
35
22
33
23
32
+160V
39
19
34
16
17
14
41
11
12
13
10
+8kV
15
42
43

COLOR SELECTION BY MIXING PRIMARY TONERS

BACKGROUND AND SUMMARY OF THE INVENTION

Color toners are used in a variety of applications by both copiers and non-impact printers. Most of the toners commercially utilized are of the dual component type in which the toning system has larger magnetic carrier beads around which smaller pigmented toner particles attach themselves. The control of the toning system is achieved by a magnetic field associated with an applicator roller. The toner particles attach themselves to the magnetic beads by means of an electrostatic force generated by the electrostatic charge of the toner particle itself. It is that charge which also reacts to the force generated by the latent electrostatic image on the photoconductive cylinder, thus developing the image with toner. The electrostatic charge is generated by the triboelectric charging of the particle, that is the static charge generated by the toner particles rubbing and tumbling against the agitator, the sides of the toner sump, and each other. The triboelectric properties of the particles are determined by the composition of the toner particles themselves. Some particles are coated by surface additives to steer the particles toward the right polarity and the right magnitude of charge. However, any change in toner composition, even if slight, can totally change the charging characteristics, and thus the quality of the print produced.

Using present toners and development systems it is extremely difficult to blend the toners uniformly because of the dependence of the tribo charging of the toner upon the composition of the toner used. To get two formulations to behave together as desired would be luck, rather than a reproducible event. Therefore some systems have introduced multi-color capability by the mixing of primary process colors on the paper. For example the Canon CLC uses four toners, each imaging on a separate pass of the imaging cylinder, then mixing at the paper to form the desired color level. Of course this is expensive and has minimal throughput. The E-Print 1000 by Indigo attempts to do a similar job with liquid toner. In each case, though, four separate color toners must be utilized to create the desired color level with the complication of four developing stations.

It is highly desirable to provide a simple charging and developing system which, by using specific primary colors of toners, would allow pre-blending before charging the system, to create specific levels of color for non-impact imaging of specified spot or highlight color applications. It is particularly desirable to make the quality and uniformity of the color insensitive to slight chemical changes in the toner (from one batch to another). These desirable features are accomplished according to the present invention.

The basic aspects of the present invention are to provide a fluidized bed of toner powders and to apply a uniform charge. This has been very difficult to accomplish in the past, and if the bed is not uniform, with a uniform charge, one color will have the tendency to deplete before the other, thereby changing the color on the printed substrate (e.g. paper). However this is avoided according to the present invention by making the various differently colored powders that are utilized in the fluidized bed so that they have substantially the same physical characteristics, such as resistivity, particle size, and flowability.

According to one aspect of the present invention, a method of applying a designated and specified level of color using a transformed mixture of primary toner colors which create that level of color to the substrate is provided. The method comprises the following steps: (a) Making at least first and second differently colored toner powders having substantially uniform physical characteristics. (b) Introducing the first and second toner powders in desired proportions into a fluidized bed. (c) Uniformly mixing the first and second toner powders together in the fluidized bed. (d) Applying a substantially uniform electrostatic charge to the toner powders in the fluidized bed. And, (e) applying the electrostatically charged mixture of toner powders to a substrate to image uniform and specified non-primary color symbols on the substrate.

Step (a) is typically practiced utilizing primary color toners as the differently colored toner powder, and two or more different powders may readily be utilized. Step (a) is also preferably practiced by making the toner powders so that the vast majority of particles making up the toner powders have a size between about 5 microns and about 25 microns (e.g. between about 10–15 microns). The resistivity of the toner powders is preferably greater than about $10^{12}$ ohm-cm. Step (a) is also practiced by making toner powders having flowability between a predefined minimum and maximum, the minimum being established by empirical means, and the maximum by the flowability that would make handling of the powder in mechanical systems too unreliable.

The method is practiced utilizing a fluidized bed apparatus such as disclosed in co-pending application Ser. No. 07/639,360 filed Jan. 8, 1991, the disclosure of which is hereby incorporated by reference herein. In that system, one or more rotors with a plurality of radially extending sharp points are mounted within the fluidized bed, serving to mix the particles together and also to apply a high, uniform charge to the particles. Typically a sufficiently high D.C. voltage is applied, with sufficient concentration, to breakdown molecules in the vicinity of the source application into individual ionic species, e.g. into positive species, comprising $H^+(H_2O)_n$, where n=1, 2, . . . 6. Normally this is accomplished by applying approximately +6.5–+8 kV potential, producing a charge sufficient to associate charges of greater (on the average) than 20 microcoulombs/gram with the individual toner particles.

According to another aspect of the present invention a method of imaging a substrate with a designated non-primary color toner while changing from one toner chemical formulation to another is provided. That method comprises the following steps: (a) Introducing a designated first and second differently colored, substantially uniformly physical property toner powders into a fluidized bed. (b) Uniformly mixing the toners together in the fluidized bed. (c) Applying an electrostatic charge to the toner particles in the fluidized bed. (d) Imaging a substrate with the charged toner particles to produce specified and designated, non-primary, uniformly colored symbols on the substrate. And, (e) accommodating slight changes in the chemical composition of the toners being introduced in step (a) without any change in the resulting imaging.

The invention also relates to a fluidized bed of uniform mixture of toner particles. The bed comprises: A first toner powder of a designated first color and having particles with predetermined physical characteristics and a predetermined charge. A second toner powder of a designated second color and having particles with predetermined physical characteristics and a predetermined charge. And, wherein the physical characteristics and predetermined charge of the first and second toner powders are substantially the same, and substantially uniform. The average predetermined charge of the particles is greater than 20 microcoulombs/gram, the vast majority of the particles have a particle size of between about 5–25 microns, and the particles have a resistivity of greater than $10^{12}$ ohm/cm. The colors typically may be primary colors, and a third toner powder or more of a primary color different than the first and second colors is also preferably provided.

It is the primary object of the present invention to provide a simple and effective method of color imaging for copiers, non-impact printers, or the like, utilizing a system that is insensitive to slight changes in chemical composition, i.e. small changes in chemical composition of the toners being added to the system not making a change in the uniformity of the imaging produced utilizing the toners, such as by utilizing a Moore MIDAX 300 system. This and other objects will become clear from an inspection of the detailed description of the invention and from the appended claims.

DETAILED DESCRIPTION OF THE DRAWINGS

Figure 1:
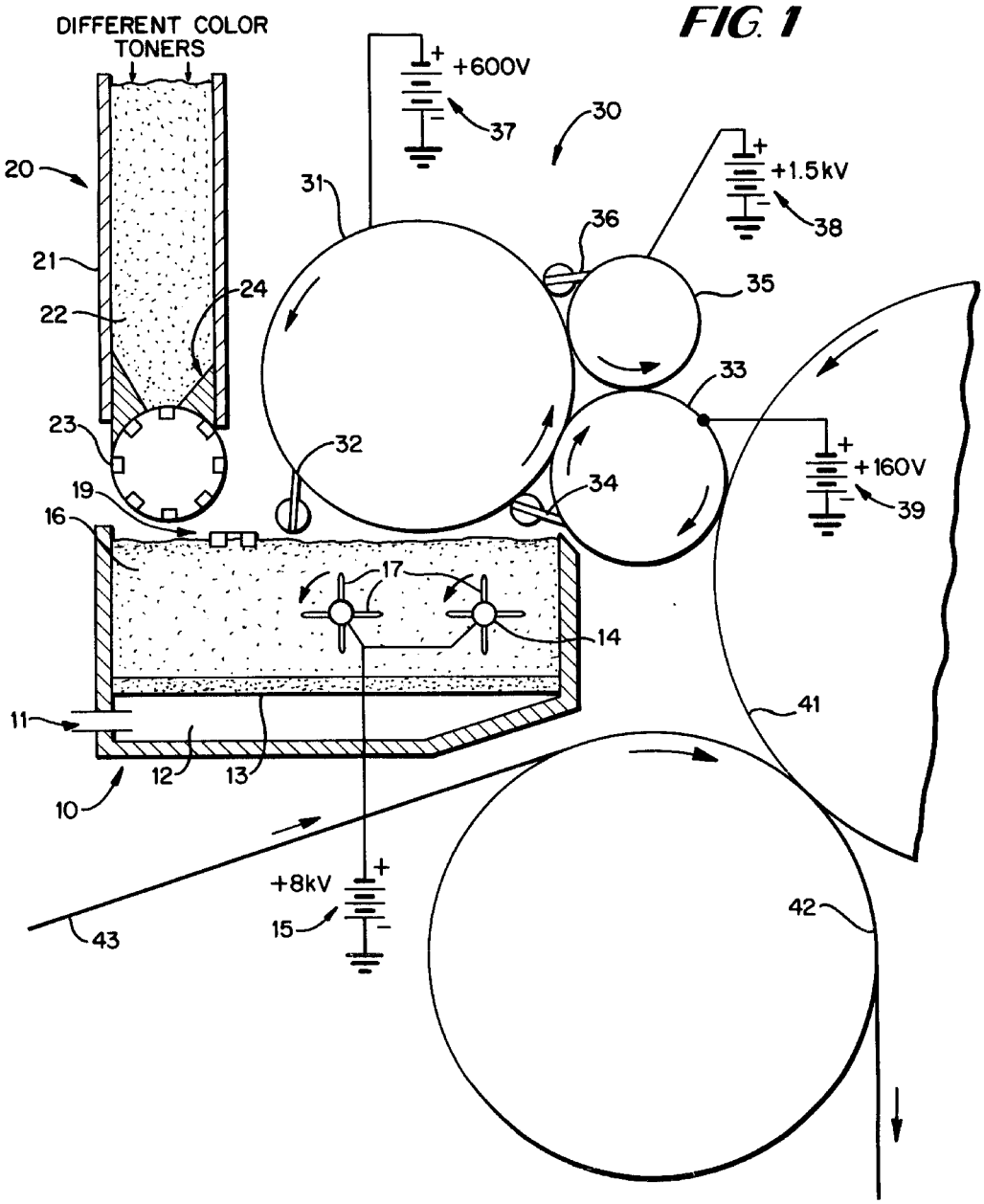
FIG. 1 is a schematic side view of an exemplary system, including the fluidized bed according to the invention, for practicing an exemplary method according to the invention.

An exemplary system for applying a specified, non-primary color print to a substrate is shown in FIG. 1. The basic apparatus illustrated in FIG. 1 is the same as that illustrated in co-pending application Ser. No. 07/639,360 filed Jan. 8, 1991, except that it has been determined that there is no need for the electrical vibrator, it being possible to provide sufficient fluidizing action with the introduced air.

The fluidized bed container 10 in FIG. 1 has an input tube 11 for fluidizing air, a distribution plenum 12, and a semi-pervious plate 13, such as a piece of porous stainless steel typically used in filtration applications in industry. The plate 13 typically has an average opening of 0.2 micrometers through its pores. The container defining the fluidized bed 10 is typically made up of an insulating polymer such as Delrin. Located within the container 10 are rotors 14 having a plurality of discharge points 17 extending radially outwardly therefrom, and supplied with a charge from the source 15, such as a +6.5–+8 kV D.C. source.

Within the container 10 are the fluidized toner particles in fluidized bed 16. According to the invention there are at least two different designated colored toner particles making up bed 16, typically two or three primary colored toners in predetermined proportions depending upon final specified and designated, non-primary color symbols desirably printed.

Each color has a characteristic hue, chroma and intensity. Hue depends on the proportion of the primary colored toners added, e.g., yellow-mag-cyan. Chroma is essentially the strength of a color and is governed by the amount of toner per square unit area applied to the substrate. Chroma can be adjusted by controlling the applied amount of clear toner. Intensity is the blackness or whiteness of the color. Intensity is controlled by adding black or white toner and depends on the brightness of the substrate.

Toner is added to the bed 16 in response to sensing by level sensor 19, utilizing the dispenser 20, while the rollers 31, 33 and 35 (typically made of plain cold roll steel plated with hard chrome and polished) are utilized to apply the toner particles to the latent electrostatic image being carried on the image cylinder 41. This image is transferred to the substrate 43 (typically, a moving web of paper), under the applied force from the impression cylinder 42 which is in opposition to the image cylinder 41, as described in co-pending application Ser. No. 07/639,360 filed Jan. 8, 1991.

The hopper (dispenser) 20, having straight side walls 21 with powdered non-conductive and non-magnetic toner 22 contained therein, cooperates with the optical sensor 19 to resupply the container 10 with toner. This is preferably accomplished by utilizing a slotted roller 23 rotatable about a generally horizontal axis, and mounted at the bottom of the side walls 21, preferably below the sloping side wall portions 24 which facilitate feeding of the powdered toner from the hopper 21 to the slots in the roller 23. The slotted roller 23 supplies a measured amount of toner into the container 10 for each rotation, or each partial rotation.

In order to achieve the desired results according to the invention, it is necessary that the physical properties of the different toners added to the bed 16 be uniform. The most important physical characteristics are particle size, resistivity, and flowability. The particle size is preferably such that the vast majority of the particles are between about 5–25 microns (typically about 10–15 microns). For example the average size of the particles may be 15 microns, which have been classified to reduce particles of less than 5 microns to under 10% of the total distribution. Other classification to remove the majority of the particles above 25 microns may be necessary under select circumstances.

The resistivity of the particles of both the first, second, or subsequent differently colored toner particles are greater than about $10^{12}$ ohm-cm, and the flowabilities between a predefined minimum and maximum. The minimum flowability will be determined empirically for different situations, while the maximum is limited by the ability of mechanical systems to reliably handle the powders.

The charge applied to the particles in the bed 16 by the plurality of discharge points 17 extending outwardly from the rotors 14 is of a sufficiently high D.C. voltage, with sufficient concentration, to breakdown molecules in the vicinity of the blades 17 into individual ionic species. For example the molecules are broken down into positive species comprising $H^+(H_2O)_n$, where n=1, 2, . . . 6. Typically the source 15 has a D.C. voltage of between about +6.5–+8 kV, and the charge supplied is sufficient to associate average charges of greater than 20 microcoulombs/gram with the individual toner particles.

One possible example of creating a specific color from two primary toners in an electrostatic fluidized bed will now be described.

EXAMPLE

The specific color to be produced is a dark purple color, identified as Pantone PMS color 259. Creation of the color is by mixing in the fluidized bed 16 a typical magenta colored primary and a typical cyan colored primary.

The cyan toner component is made as follows. Blend approximately 4% copper pthalocyanine pigment into a polyester resin matrix (e.g. ATLAC 382E by Reichold). This compound is jet-milled to an average particle size of 15 microns and classified to reduce particles of less than 5 microns to under 10% of the total distribution. This powder is postblended with 0.75% by weight of the treated fumed silica flowing agent (e.g. Cabot TS-530 or equivalent) in a high speed mixer such as a Henschell or an Omni.

The magenta component starts with a blend of approximately 4% Hasta-Perm PINK-E pigment (Harshaw Chemical) in the same polyester resin used in the cyan blend above. All processing of the toner is done in the same sizing, grinding, classification, and post blending steps as those described above.

Both primary components are then blended together, either before introduction into the electrostatic fluidized bed 16, or actually mixed into the bed 16. For the purple color described above, the typical ratio would be very near three parts of magenta toner to one part of the cyan toner.

In a second example, five separate intensities of blue, including PMS 290, were produced by incrementally diluting a cyan primary with a white toner.

The cyan component of the blend is made as described above. The white component starts with a blend of approximately 4.5% titanium dioxide pigment in the same polyester resin used in the cyan blend. Both the white and cyan primary components are then blended together either before introduction into the electrostatic fluidized bed 16, or actually mixed into the bed. Diluting in a serial fashion, a ratio of 1 part white to 2.5 parts cyan will produce a PMS 299 shade. Using this blend as a new primary shade, a second dilution of 1 part white to 2.5 parts of the blend produced very nearly a PMS 298 shade. Successive further dilutions in the same ratio yielded a PMS 297 shade, a PMS 290, and a final shade lighter than PMS 290 not found in the listed color sample.

Figure 2:
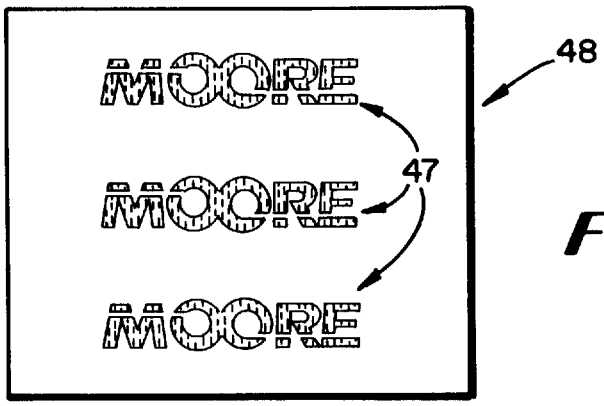
FIG. 2 is a plan view of a substrate with uniform non-black, non-primary color print produced according to the invention.

The multi-roller electrostatic toning unit is operated then in the normal mode as described in co-pending application Ser. No. 07/639,360. Approximately a +6.5 to +8.0 kV potential is applied to the in-bed corona arrays, 14, 17 which creates a large population of positive ionic species. These ions attach to both the cyan and magenta toner particles in equal proportions. This mixed blend of toners transfers via electrical field forces from roller 31 to roller 33, ultimately onto the image cylinder 41. From there, the mix of cyan and magenta toners is transferred to the paper 43 and fused to the paper infra-red heating. Through the process, the individual toner particles lose their individual color properties because of their small size, the amount of mixing and motion going on, and the final combination together into a singular fused image on the paper. What results is the desired dark purple image symbols 47 on the paper 48 (see FIG. 2). This same principle was also demonstrated in the serial dilution in the shades for the light blue PMS series.

The fluidized bed 16 is insensitive to changes in chemical composition of the toner that is being introduced, unlike prior art systems. Thus a completely uniformly colored print of symbols 47 is provided.

It will thus be seen that according to the present invention a simple, effective method (and fluidized bed) for printing a substrate, such as paper, with toner, useful for both copier and non-impact printing (such as electrostatic printing) is provided. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims to encompass all equivalent methods and systems.

What is claimed is:

1. A method of applying a designated, non-primary color print to a substrate, comprising the steps of:

(a) making at least first and second differently colored toner powders having substantially uniform physical characteristics;

(b) introducing the first and second toner powders in desired proportions into a fluidized bed;

(c) uniformly mixing the first and second toner powders together in the fluidized bed;

(d) applying a substantially uniform electrostatic charge to the toner powders in the fluidized bed; and (e) applying the electrostatically charged mixture of toner powders to a substrate to form uniform non-primary color symbols on the substrate.

2. A method as recited in claim 1 wherein step (a) is practiced utilizing primary color toners as the first and second differently colored toner powders.

3. A method as recited in claim 1 wherein step (a) is practiced by making the toner powders so that the vast majority of particles making up the toner powders have a size of between about 5 microns and about 25 microns.

4. A method as recited in claim 1 wherein step (a) is practiced by making the toner powders so that the vast majority of particles making up the toner powders have a size between about 10 microns and about 15 microns.

5. A method as recited in claim 1 wherein step (a) is practiced by making toner powders having a resistivity of greater than about $10^{12}$ ohm-cm.

6. A method as recited in claim 5 wherein step (a) is practiced by making the toner powders so that the vast majority of particles making up the toner powders have a size of between about 5 microns and about 25 microns.

7. A method as recited in claim 6 wherein step (a) is practiced by making toner powders having flowability between a predefined minimum and maximum by utilizing a post blended flowing agent to the basic toner.

8. A method as recited in claim 7 wherein the flowability of the toner powders is adjusted by utilizing a post blended flowing agent to the basic toner.

9. A method as recited in claim 7 wherein step (d) is practiced by applying approximately +6.5–+8 kV potential to the powders in the fluidized bed.

10. A method as recited in claim 1 wherein step (a) is practiced by making toner powders having flowability between a predefined minimum and maximum.

11. A method as recited in claim 1 wherein step (c) is practiced by simultaneously subjecting the toner powders to rotating mechanical structures while fluidizing them.

12. A method as recited in claim 1 wherein step (d) is practiced by applying a sufficiently high D. C. voltage source with sufficient concentration to break down molecules in the vicinity of the source application into individual ionic species.

13. A method as recited in claim 12 wherein step (d) is further practiced to break down the molecules into positive species comprising $H^+(H_2O)_n$, where n=1, 2, . . . 6.

14. A method as recited in claim 1 wherein step (e) is practiced by transferring the uniformly charged and mixed toner powders to one or more rollers, and bringing a roller with charged toner particles into contact with the substrate to be imaged.

15. A method as recited in claim 14 wherein step (e) is practiced by transferring the uniformly charged and mixed toner powders on an image cylinder and transferring the charged toner particles to the substrate to be imaged.

16. A method as recited in claim 1 wherein step (d) is practiced by applying approximately +6.5–+8 kV potential to the powders in the fluidized bed.

17. A method as recited in claim 1 wherein step (d) is practiced by applying a charge sufficient to associate average charges of greater than 20 microcoulombs/gram with the individual toner particles.

18. A method of printing a substrate with a designated non-primary color toner while changing from one toner chemical formulation to another, comprising the steps of:

(a) introducing designated, first and second differently colored, substantially uniformly physical property toner powders into a fluidized bed;

(b) uniformly mixing the toners together in the fluidized bed;

(c) applying an electrostatic charge to the toner particles in the fluidized bed;

(d) applying with the charged toner particles to produce designated, non-primary, uniformly colored symbols to form an image on the substrate; and (e) accommodating slight changes in the chemical composition of the toners being introduced in step (a) without any change in the resulting imaging.

19. A method as recited in claim 18 wherein step (a) is practiced by utilizing toner powders wherein the vast majority of particles making up the toner powders have a size of between about 5 microns and about 25 microns.

20. A method as recited in claim 19 wherein step (a) is practiced by making toner powders having a resistivity of greater than about $10^{12}$ ohm-cm.

21. A method as recited in claim 20 wherein step (a) is practiced by making toner powders having flowability between a predefined minimum and maximum by utilizing a post blended flowing agent to the basic toner.

22. A method as recited in claim 21 wherein step (c) is practiced by applying a charge sufficient to associate average charges of greater than 20 microcoulombs/gram with the individual toner particles.

* * * * *